US006199659B1

(12) United States Patent
Allman

(10) Patent No.: US 6,199,659 B1
(45) Date of Patent: Mar. 13, 2001

(54) STAMP-FORMED MUFFLER

(75) Inventor: James R. Allman, North Vernon, IN (US)

(73) Assignee: Arvin Industries, Inc., Columbus, IN (US)

( * ) Notice: Subject to any disclaimer, the term of this patent is extended or adjusted under 35 U.S.C. 154(b) by 0 days.

(21) Appl. No.: 09/264,234

(22) Filed: Mar. 5, 1999

Related U.S. Application Data

(60) Provisional application No. 60/076,858, filed on Mar. 5, 1998.

(51) Int. Cl.[7] ..... F01N 7/18; B23P 15/00

(52) U.S. Cl. ..... 181/282; 181/272; 29/890.08

(58) Field of Search ..... 181/282, 265, 181/266, 269, 272, 276; 29/890.08

(56) References Cited

U.S. PATENT DOCUMENTS

| | | | |
|---|---|---|---|
| 2,484,826 | | 10/1949 | Harley . |
| 3,638,756 | | 2/1972 | Thiele . |
| 4,132,286 | | 1/1979 | Hasui et al. . |
| 4,415,059 | | 11/1983 | Havashi . |
| 4,456,091 | | 6/1984 | Blanchot . |
| 4,860,853 | * | 8/1989 | Moring, III ..... 181/282 |
| 4,901,816 | | 2/1990 | Garey . |
| 4,909,348 | | 3/1990 | Harwood et al. . |
| 4,928,372 | | 5/1990 | Harwood et al. . |
| 4,941,545 | | 7/1990 | Wilcox et al. . |
| 4,953,660 | | 9/1990 | Jewell, Jr. et al. . |
| 5,147,987 | | 9/1992 | Richardson et al. . |
| 5,229,557 | | 7/1993 | Allman et al. . |
| 5,252,788 | | 10/1993 | Emrick et al. . |
| 5,332,873 | * | 7/1994 | Kullander et al. ..... 181/282 |
| 5,563,385 | | 10/1996 | Harwood . |
| 5,597,986 | | 1/1997 | Harwood et al. . |
| 5,717,173 | | 2/1998 | Gerber et al. . |
| 5,816,361 | | 10/1998 | Gerber . |
| 5,907,904 | | 6/1999 | Gerber et al. . |

FOREIGN PATENT DOCUMENTS

| | | |
|---|---|---|
| 2 120 318A | 11/1983 | (GB) . |
| 59-41618 | 3/1984 | (JP) . |
| 56-154512 | 12/1984 | (JP) . |

* cited by examiner

*Primary Examiner*—Khanh Dang
(74) *Attorney, Agent, or Firm*—Barnes & Thornburg

(57) ABSTRACT

A muffler includes an outer shell defining a chamber and first and second inner plates positioned to lie in the chamber. The second inner plate includes a base portion, a baffle integral with the base portion, and a tube portion integral with the base portion. The base portion includes an outer periphery defining a base portion boundary. The baffle extends between the base portion and the outer shell and the tube portion is positioned outside the boundary of the base portion.

42 Claims, 4 Drawing Sheets

STAMP-FORMED MUFFLER

This application claims priority under U.S.C. § 119 (e) to U.S. Provisional application Ser. No. 60/076,858, filed Mar. 5, 1998, which is expressly incorporated by reference herein.

BACKGROUND AND SUMMARY OF THE INVENTION

The present invention relates to exhaust systems and, in particular, to mufflers for quieting the exhaust noise of a vehicle engine. More particularly, this invention relates to mufflers having stamped outer shells and stamped inner plates.

It is known to construct mufflers using stamp-formed outer shells and inner plates. See, for example, U.S. Pat. No. 5,252,788 to Ernrick et al.; U.S. Pat. No. 5,229,557 to Allman et al.; U.S. Pat. No. 5,147,987 to Richardson et al.; U.S. Pat. No. 5,004,069 to Van Blaircum et al.; U.S. Pat. No. 4,941,545 to Wilcox et al.; U.S. Pat. No. 4,860,853 to Moring; U.S. Pat. No. 4,736,817 to Harwood; and Re. U.S. Pat. No. 33,370 to Harwood.

Stamp-formed mufflers include a plurality of subchambers and tubes formed between the stamped outer shells and inner plates. The subchambers and tubes direct exhaust gas of the vehicle engine through the muffler in a desired manner to quiet the exhaust noise produced by the vehicle engine.

According to the present invention, a muffler is provided including an outer shell defining a chamber and first and second inner plates positioned to lie in the chamber. The second inner plate includes a base portion, a baffle integral with the base portion, and a tube portion integral with the base portion. The base portion includes an outer periphery defining a base portion boundary. The baffle extends between the base portion and the outer shell and the tube portion is positioned outside the boundary of the base portion.

In a preferred embodiment, the second inner plate includes first and second folds that partition the second inner plate into the base portion and first and second baffle segments. The first and second baffle segments cooperate to define the baffle.

In another preferred embodiment, the first inner plate includes a base portion that cooperates with the base portion of the second inner plate to define a first baffle. The baffle of the second inner plate provides a second baffle and the second inner plate includes a third baffle integrally coupled to the base portion of the second inner plate. The base portion of the second inner plate defines a plane that partitions the outer shell into first and second outer shell portions. The second baffle extends between the base portion of the second inner plate and the first outer shell portion and the third baffle extends between the base portion of the second inner plate and the second outer shell portion.

According to a method of the present invention, a method is provided for assembling a muffler including an outer shell, a first inner plate, and a second inner plate. The second inner plate includes a base portion, a first baffle segment integral with the base portion, a second baffle segment integral with the base portion, and a tube portion integral with the base portion. The first baffle segment is positioned in an upright position relative the base portion. The second baffle segment is positioned relative the base portion so that the second baffle is positioned over the tube portion and the first and second baffle segments cooperate to define a baffle. The first inner plate is positioned adjacent the second inner plate and the first and second inner plates are positioned in the outer shell.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
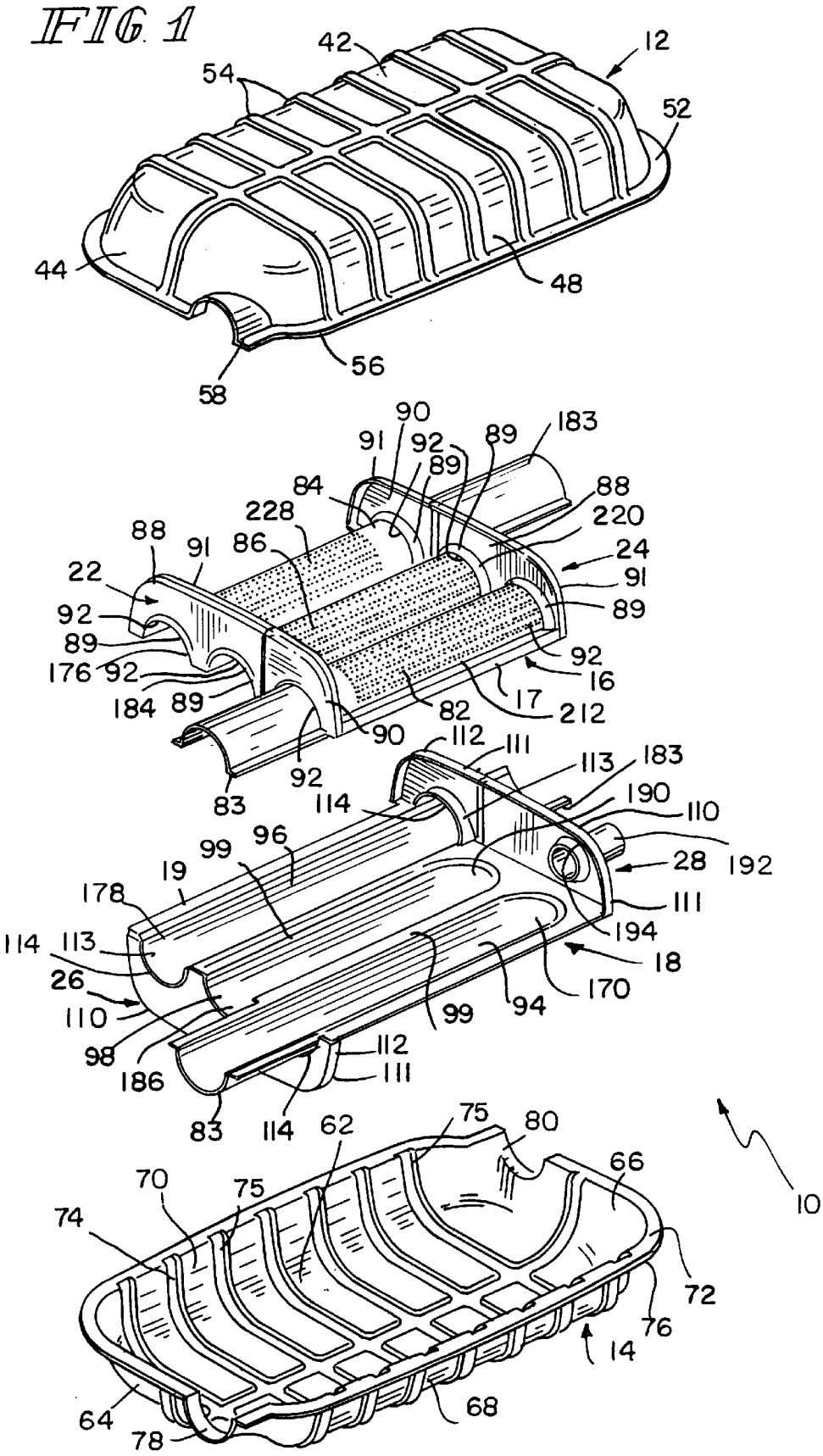
FIG. 1 is an exploded perspective view of a stamp-formed muffler according to the present invention showing the stamp-formed muffler including a stamped top outer shell, a stamped bottom outer shell, a first stamped inner plate having spaced-apart fold-up baffles, and a second stamped inner plate having spaced-apart fold-up baffles.

A stamp-formed muffler 10 according to the present invention is shown in FIG. 1. Stamp-formed muffler 10 includes a stamped top outer shell 12, a stamped bottom outer shell 14, a first stamped inner plate 16, and a second stamped inner plate 18, as shown in FIGS. 1–6. First and second inner plates 16, 18 include 20 respective base portions 17, 19 and first, second, third, and fourth fold-up baffles 22, 24, 26, 28 integrally coupled to respective base portions 17, 19 that cooperate with top and bottom outer shells 12, 14 to define first, second, third, and fourth subchambers 30, 32, 34, 36 between first and second inner plates 16, 18 and top and bottom outer shells 12, 14 as shown in FIGS. 1–6. First and second inner plates 16, 18 further include inlet and outlet tube portions 83, 85 integrally coupled to respective base portions 17, 19 that extend beyond respective fold-up baffles 22, 24, 26, 28.

Figure 2:
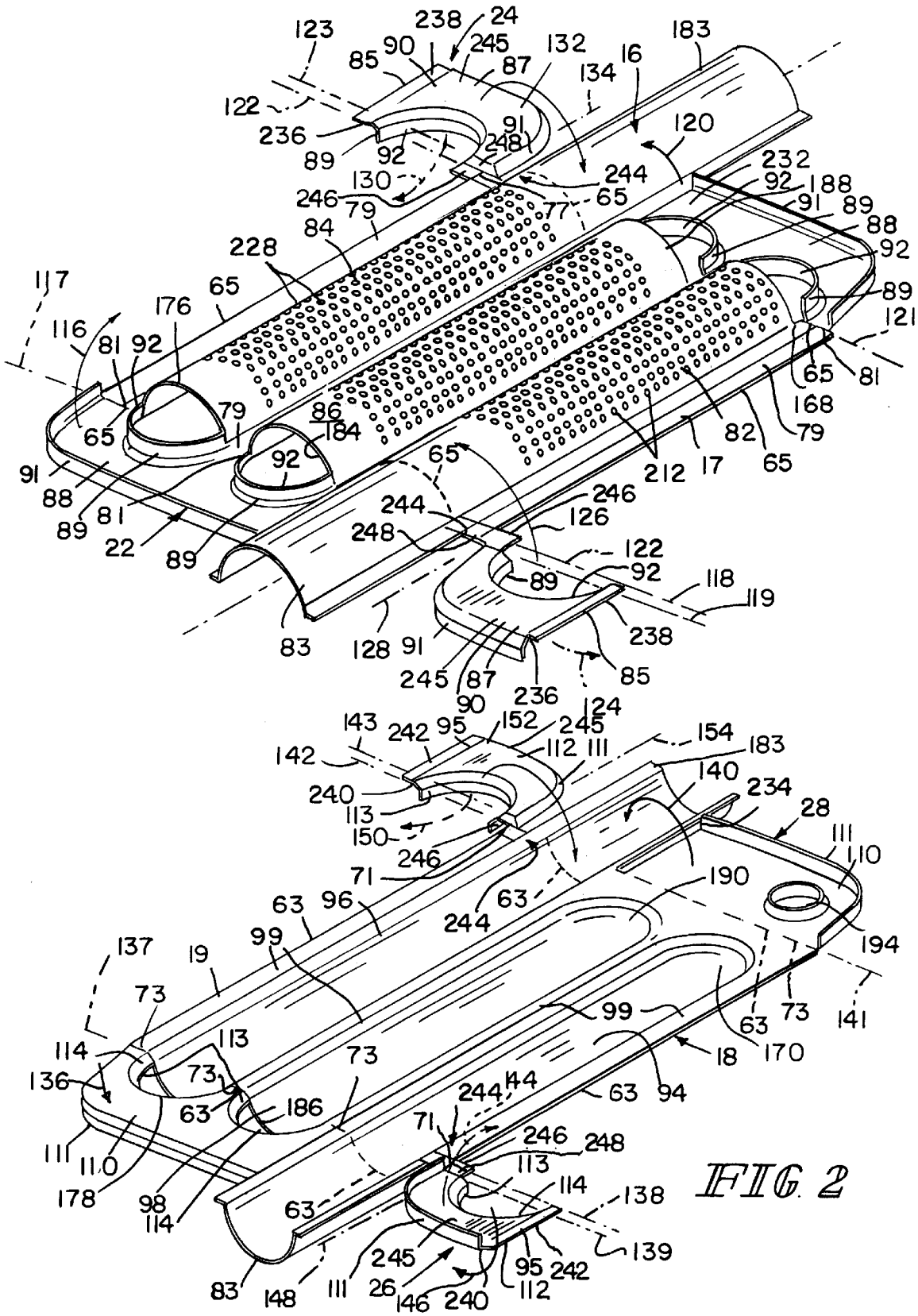
FIG. 2 is a perspective view of the first and second stamped inner plates in their initial stamped position showing the first and second inner plates each including base portions formed to include three tube segments, tube portions integrally coupled to the respective base portions, and split first and second baffle segments integrally coupled to the respective base portions.
Figure 3:
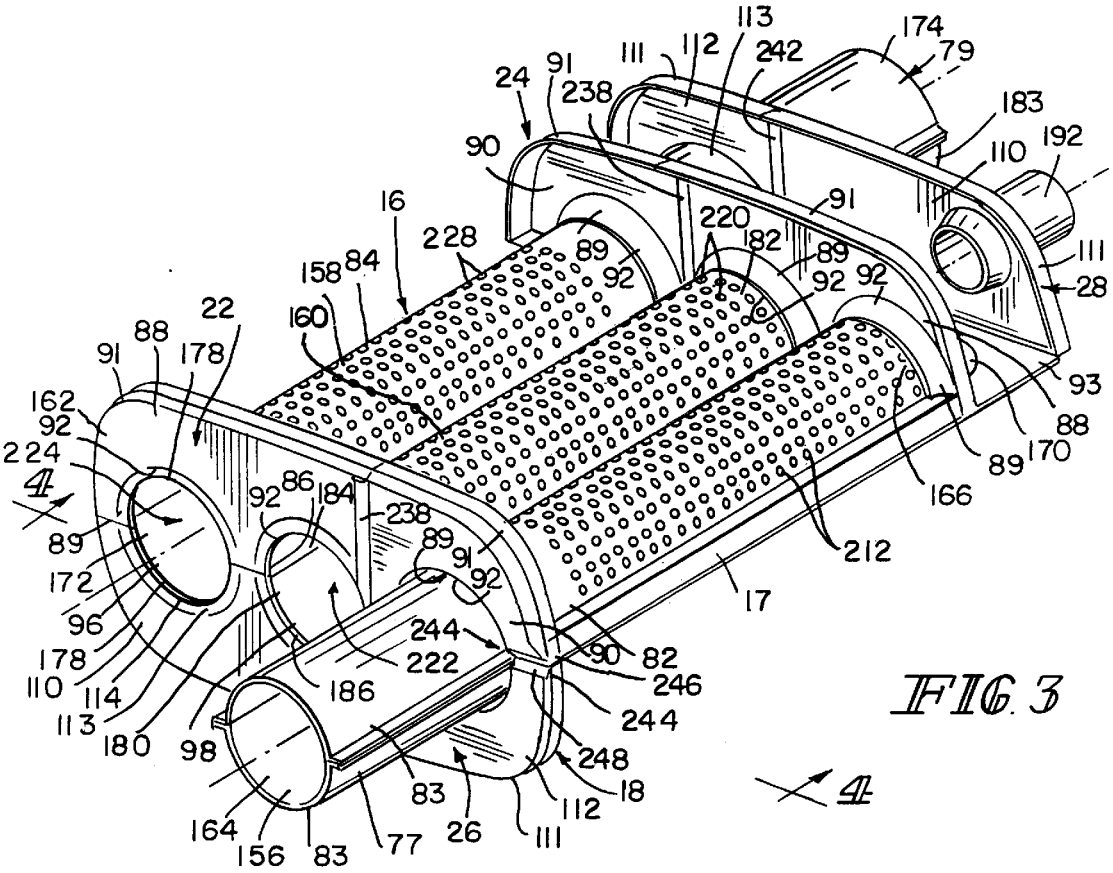
FIG. 3 is a perspective view of the first and second inner plates connected together showing the tube segments formed in the base portions of the first and second inner plates cooperating with the tube portions to define a plurality of tubes and the fold-up baffles being folded to their folded position to define a "full" baffle and two "half" baffles.

First and second fold-up baffles 22, 24 of first inner plate 16 include split first and second baffle segments 88, 90 and third and fourth fold-up baffles 26, 28 of second inner plate 18 include split first and second baffle segments 110, 112 as shown, for example, in FIGS. 1–3. Second baffle segments 90, 112 fold over respective inlet and outlet tube portions 83, 183 to engage first baffle segments 88, 110, respectively as shown, for example, in FIGS. 2 and 3 to define first, second, third, and fourth fold-up baffles 22, 24, 26, 28. Base portions 17, 19 are formed to include respective tube segments 82, 84, 86, 94, 96, 98 that cooperate with respective inlet and outlet tube portions 83, 183 of first and second inner plates 16, 18 to define inlet, intermediate, and outlet tubes 156, 160, 158 that direct exhaust gas into, through, and out of muffler 10 as shown in FIG. 3.

Figure 5:
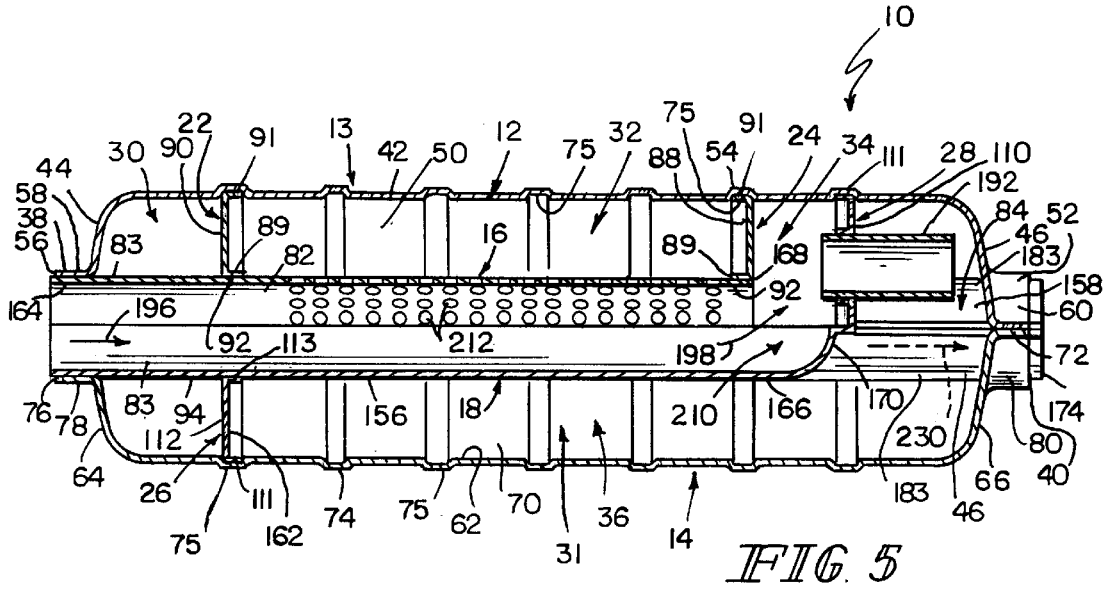
FIG. 5 is a sectional view taken along line 5—5 of FIG. 4, showing the fold-up baffles defining a plurality of subchambers between the top and bottom outer shells and the first and second inner plates.

Because first and second inner plates 16, 18 have inlet and outlet tube portions 83, 183 that extend beyond fold-up baffles 22, 24, 26, 28, muffler 10 may be made of only four stamped parts: 1) stamped top outer shell 12, 2) stamped bottom outer shell 14, 3) first stamped inner plate 16, and 4) second stamped inner plate 18. Split baffle segments 88, 90, 110, 112 of fold-up baffles 22, 24, 26, 28 permit first and second inner plates 16, 18 to provide pathways for exhaust gas to enter and exit muffler 10 through inlet and outlet tube portions 83, 183. In addition, fold-up baffles 22, 24, 26, 28 define first and fourth subchambers 30, 36 with top and bottom outer shells while permitting inlet and outlet tube portions 83, 183 to extend through these first and fourth subchambers 30, 36 from base portions 17, 19 of first and second inner plates 16, 18 to top and bottom outer shells 12, 14 as shown in FIG. 5.

Top and bottom outer shells 12, 14 cooperate to define an outer shell 13 defining a chamber 31 therein. Other configurations of outer shells known to those of ordinary skill in the art may also be used with inner plates 16, 18.

Figure 4:
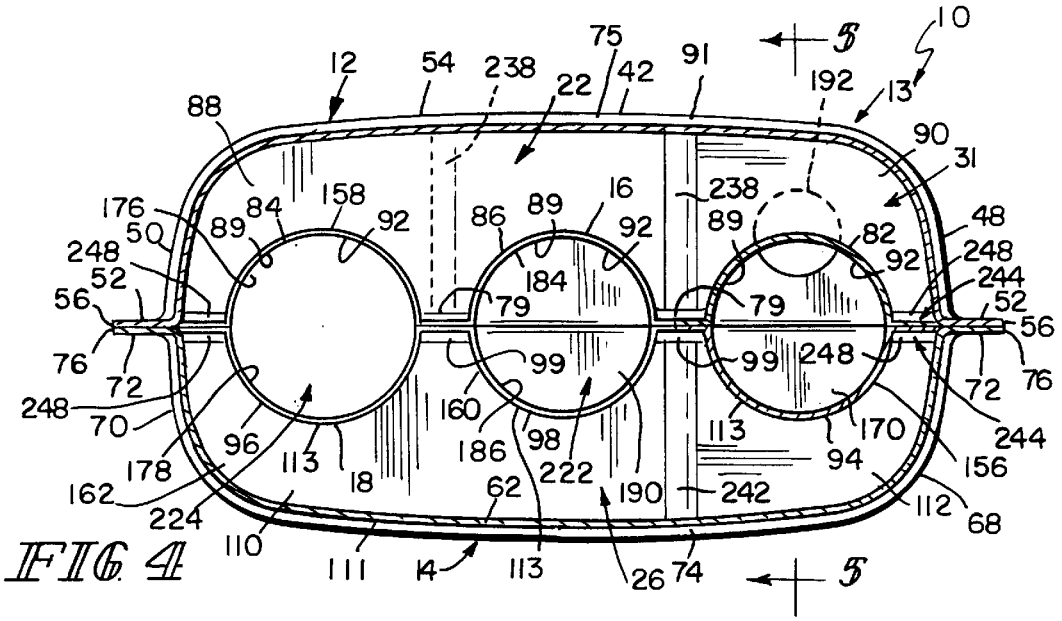
FIG. 4 is a sectional view taken along line 4—4 of FIG. 3, showing the first and second inner plates being positioned between the top and bottom outer shells.

Top outer shell 12 is formed to include various contours and edges. Top outer shell 12 includes a top wall 42, first and second end walls 44, 46, first and second side walls 48, 50 extending between first and second end walls 44, 46, and a perimeter flange 52 appended to side walls 48, 50 and end walls 44, 46 as shown in FIGS. 1 and 3–5. First and second end walls 44, 46 and first and second side walls 48, 50 are appended to top wall 42 and arranged to extend from top wall 42 to perimeter flange 52 at a perimeter edge 56 as shown in FIGS. 1, 3, and 4. Top wall 42, first and second end walls 44, 46, and first and second side walls 48, 50 are formed to include stiffening ribs 54. Stiffening ribs 54 raise the resonant frequency of the top outer shell 12 which reduces the vibration of and noise created by top outer shell 12. First end wall 44 is formed to include an inlet passageway 58 and second end wall 46 is formed to include an outlet passageway 60 as shown in FIGS. 1 and 5.

Similar to top outer shell 12, bottom outer shell 14 is also formed to include various contours and edges. Bottom outer shell 14 includes a bottom wall 62, first and second end walls 64, 66, first and second side walls 68, 70 extending between first and second end walls 64, 66, and a perimeter flange 72 appended to end walls 64, 66 and side walls 68, 70. First and second end walls 64, 66 and first and second side walls 68, 70 are appended to bottom wall 62 and arranged to extend from bottom wall 62 to perimeter flange 72 at a perimeter edge 76 as shown in FIGS. 1 and 3–5. Bottom wall 62, first and second end walls 64, 66, and first and second side walls 68, 70 are formed to include stiffening ribs 74. Stiffening ribs 74 raise the resonant frequency of the bottom outer shell 14 which reduces the vibration of and noise created by bottom outer shell 14. First end wall 64 is formed to include an inlet passageway 78 and second end wall 66 is formed to include an outlet passageway 80 as shown in FIGS. 1, 4, and 5.

As previously mentioned, top and bottom outer shells 12, 14 cooperate to define chamber 31 that accepts first and second inner plates 16, 18. Top and bottom outer shells 12, 14 mate along perimeter edges 56, 76 to secure first and second inner plates 16, 18 between top and bottom outer shells 12, 14 as shown, for example, in FIGS. 4 and 5. Top and bottom shells 12, 14 are mated together by welding, crimping, or other any other technique of coupling along perimeter edges 56, 76.

First and second inner plates 16, 18 are stamped from a sheet of stainless steel in the shape as shown in FIG. 2. In alternative embodiments, the components of the muffler may be stamped from sheets of cold-rolled stainless steel, aluminized stainless steel, or any other appropriate type of material. First inner plate 16 includes base portion 17 including an outer periphery 65 defining a base portion boundary, first and second fold-up baffles 22, 24 integrally coupled to base portion 17 as shown, for example, in FIGS. 1–3, and inlet and outlet tube portions 83, 183 integrally coupled to base portion 17 at outer periphery 65. Base portion 17 is formed to include an inlet tube segment 82, an outlet tube segment 84, an intermediate tube segment 86 positioned between and outside of inlet and outlet tube segments 82, 84, and flat portions 79 positioned to lie between tube segments 82, 84, 86 as shown in FIG. 2. First and second fold-up baffles 22, 24 each include a first baffle segment 88 integrally coupled to base portion 17 at respective locations along respective folds 81, a second baffle segment 90 integrally coupled to base portion 17 at respective locations along respective folds 77 that are spaced apart from the locations defined by folds 81, an outer perimeter flange 91 defining an outer perimeter of baffles 22, 24, and inner flanges 89 defining tube-receiving apertures 92.

Second inner plate 18 is similar to first inner plate 16 and includes base portion 19 including an outer periphery 63 defining a base portion boundary, third and fourth fold-up baffles 26, 28 integrally coupled to base portion 19, and inlet and outlet tube portions 83, 183 integrally coupled to base portion 19 at outer periphery 63. Base portion 19 is formed to include an inlet tube segment 94, an outlet tube segment 96, an intermediate tube segment 98 positioned between and outside of inlet and outlet tube segments 94, 96, and flat portions 99 positioned to lie between tube segments 94, 96, 98 as shown in FIG. 2. Third and fourth fold-up baffles 26, 28 each include a first baffle segment 110 integrally coupled to base portion 19 at respective locations along respective folds 73, a second baffle segment 112 integrally coupled to base portion 19 at respective locations along folds 71 that are spaced apart from the locations defined by folds 73, an outer perimeter flange 111 defining an outer perimeter of baffles 26, 28, and inner flanges 113 defining tube-receiving apertures 114 on third fold-up baffle 26.

First and second inner plates 16, 18 are manipulated from their original stamped position as shown in FIG. 2 to their folded position as shown in FIG. 3. First and second fold-up baffles 22, 24 of first inner plate 16 are initially positioned to lie flat in a plane substantially parallel with a plane defined by flat portions 79 of base portion 17 and similarly, third and fourth fold-up baffles 26, 28 of second inner plate 18 are initially positioned to lie flat in the a plane substantially parallel with a plane defined by flat portions 99 of base portion 19. First, second, third, and fourth fold-up baffles 22, 24, 26, 28 are folded from their flat position, shown in FIG. 2, to a folded position as shown in FIGS. 1 and 3–6. When first, second, third, and fourth fold-up baffles 22, 24, 26, 28 are in their folded position, first and second fold-up baffles 22, 24 extend between base portion 17 of first inner plate 16 and top outer shell 12, third fold-up baffle 26 extends between base portion 19 of second inner plate 18 and bottom outer shell 14, and fourth fold-up baffle 28 extends between base portion 19 of second inner plate 18 and top outer shell 12 to define first, second, third, and fourth subchambers 30, 32, 34, 36 as shown, for example, in FIG. 5.

First baffle segment 88 of first fold-up baffle 22 is folded 90° in direction 116 about axis 117, as shown in FIG. 2, to reach the folded upright position shown, for example, in FIGS. 1 and 3. Similarly, first baffle segment 88 of second fold-up baffle 24 is folded 90° in direction 120 about an axis 121, as shown in FIG. 2, to reach the folded upright position shown, for example, in FIGS. 1 and 3.

Second baffle segment 90 of first fold-up baffle 22 is first folded 90° in direction 124 about axis 119 and then folded 180° in direction 126 about axis 128 over inlet tube segment 82, as shown, in FIG. 2 to reach the folded position shown, for example, in FIGS. 1 and 3. Similarly, second baffle segment 90 of second fold-up baffle 24 is first folded 90° in direction 130 about axis 123 and then folded 180° in direction 132 about an axis 134 over outlet tube segment 84, as shown, in FIG. 2 to reach the folded position shown, for example, in FIGS. 1 and 3. After folding first and second baffle segments 88, 90, inlet and outlet tube portions 83, 183 of first inner plate 16 extend beyond respective first and second fold-up baffles 26, 28 as shown, for example, in FIG. 3. Thus, inlet and outlet tube portions 83, 183 of first inner plate 16 are positioned outside of the base portion boundary defined by outer periphery 65 of base portion 17.

First baffle segment 110 of third fold-up baffle 26 is folded 90° in direction 136 about axis 137, as shown in FIG. 2, to reach the folded upright position shown, for example, in FIGS. 1 and 3. Similarly, first baffle segment 110 of fourth fold-up baffle 28 is folded 90° in direction 140 about axis 141, as shown in FIG. 2, to reach the folded upright position shown, for example, in FIGS. 1 and 3.

Second baffle segment 112 of third fold-up baffle 26 is first folded 90° in direction 144 about axis 139 and then folded 180° in direction 146 about an axis 148 over inlet tube segment 94, as shown in FIG. 2, to reach the folded position shown, for example, in FIGS. 1 and 3. Similarly, second baffle segment 112 of fourth fold-up baffle 28 is first folded 90° in direction 150 about axis 143 and then folded 180° in direction 152 over outlet tube segment 96 about an axis 154, as shown in FIG. 2, to reach the folded position shown, for example, in FIGS. 1 and 3. Thus, inlet and outlet tube portions 83, 183 of second inner plate 18 are positioned to lie outside of the base portion boundary defined by outer periphery 63 of base portion 19.

As shown in FIG. 5, third fold-up baffle 26 and fourth fold-up baffle 28 extend in opposite directions from base portion 19. Flat portions 99 of base portion 19 of second inner plate 18 define a plane partitioning outer shell 13 into lower and upper portions so that third fold-up baffle 26 extends between base portion 19 and the lower portion of outer shell 13 and fourth fold-up baffle 28 extends between base portion 19 and the upper portion of outer shell 13.

Second baffle segments 90, 112 include hinges 244 connected to base portions 17, 19, respectively, as shown, for example, in FIG. 2 and base portions 245 coupled to hinges 244. Each hinge 244 includes a first portion 246 connected to respective base portions 17, 19 and a second portion 248 connected to each first portion 246 and base portions 245. First and second portions 246, 248 of hinges 244 permit second baffle segments 90, 112 to fold to their folded position. For example, second baffle segment 112 of baffle plate 26 folds as follows: first, as shown in FIG. 2, second baffle segment 112 is folded 90° about axis 139 so that first and second portions 246, 248 of hinge 244 do not move and base portion 245 of second baffle segment 112 rotates about axis 139. Next, second baffle segment 112 is folded 180° about axis 148 so that base portion 245 and first and second portions 246, 248 of hinge 244 rotate about axis 148 so that first portion 246 of hinge 244 overlaps flat portion 99 of base 19.

Creases may be stamped in each hinge to define each portion and aid in folding. The baffles may also be folded at angles other than 90° to increase or decrease the volume of the subchambers. Alternatively, the second baffle segments 90, 112 may be folded 90° about respective axes 119, 121, 139, 141 so that first portions 246 of hinges 244 do not move and second portions 248 and base portion 245 rotate about respective axes 119, 121, 139, 141 and first and second portions 246, 248 and base portions 245 are then rotated about respective axes 128, 134, 148, 154 to assume folded positions.

First baffle segments 88 of fold-up baffles 22, 24 each include a flat edge 232 extending between outer perimeter flange 91 and base portion 17 and first baffle segments 110 of fold-up baffles 22, 24 each include a flat edge 234 extending between outer perimeter flange 111 and base portion 19 as shown, for example, in FIG. 2. Second baffle segments 90 of fold-up baffles 26, 28 include a flat edge 236 extending between outer perimeter flange 91 and inner flange 89 and a flap 238 coupled to flat edge 236 and arranged to extend between inner flange 89 and outer perimeter flange 91. Flaps 238 and second baffle segments 90 each include a surface 85, 87, respectively, and each surface 85, 87 defines a plane. The plane of surface 85 of flaps 238 is slightly offset from the respective plane of surface 87 of second baffle segments 90. Similarly, second baffle segments 112 of fold-up baffles 26, 28 include a flat edge 240 extending between outer perimeter flange 111 and inner flange 113 and a flap 242 connected to flat edge 240 and arranged to extend between inner flange 113 and outer perimeter flange 111. Flaps 242 and second baffle segments 112 each include a surface 95, 97, respectively, and each surface 95, 97 defines a plane. The plane of surface 95 of flaps 242 is slightly offset from the respective plane of surface 97 of second baffle segments 112.

When split first and second baffle segments 88, 90 of first and second fold-up baffles 22, 24 are folded to their folded position, each flat edge 232 of first baffle segment 88 abuts or is positioned near flat edge 236 of second baffle segment 90 and each flap 238 of second baffle segments 90 overlaps flat edge 232 of first baffle segment 88 to substantially close any gap between split first and second baffle segments 88, 90. Flap 238 is welded to flat edge 232 or mechanically coupled using any other technique. Similarly, when split first and second baffle segments 110, 112 of third and fourth fold-up baffles 26, 28 are folded to their folded position, flat edge 234 of first baffle segment 110 abuts or is positioned near flat edge 240 of second baffle segment 112 and flap 242 of second baffle segment 112 overlaps flat edge 234 of first baffle segment 110 to substantially close any gap between split first and second baffle segments 110, 112. Flap 242 is welded to flat edge 234 or mechanically coupled in any other technique. Flaps 238, 242 close gaps between split baffle segments 88, 90, 110, 112 so that subchambers 30, 32, 34, 36 are adequately sealed.

Outlet tube portion 183 adjacent second fold-up baffle 24 is inserted through tube-receiving aperture 92 adjacent second baffle segment 112 of fourth fold-up baffle 28 so that first and second inner plates 16, 18 connect together as shown in FIGS. 3–6. Base portion 17 of first inner plate 16 engages base portion 19 of second inner plate 18 when first and second plates 16, 18 are connected. In preferred embodiments of the present invention, first and second inner plates 16, 18 are coupled together by seam-welding flat portions 79, 99 of first and second inner plates 16, 18. In yet another alternative embodiment of the present invention, the base portions of first and second inner plates extend out to lie between the perimeter edges of the top and bottom outer shells. The base portions are then coupled to top and bottom outer shells by crimping, welding, or any other technique of coupling.

When first and second inner plates 16, 18 mate together, inlet tube segments 82, 94 and respective inlet tube portions 83 combine to form inlet tube 156, outlet tube segments 84, 96 and respective outlet tube portions 183 combine to form outlet tube 158, and intermediate tube segments 86, 98 combine to form intermediate tube 160 as shown in FIGS. 3 and 4. Exhaust gas flows from a muffler inlet 38 to a muffler outlet 40 along a serpentine path through inlet tube 156, intermediate tube 160, and outlet tube 158.

First and third fold-up baffles 22, 26 cooperate to define a "full" baffle 162 that extends between top wall 42 of top outer shell 12 and bottom wall 62 of bottom outer shell 14 to lie substantially perpendicular to top wall 42 and bottom wall 62 as shown in FIG. 5. Outer perimeter flange 91 of first fold-up baffle 22 engages top outer shell 12, outer perimeter flange 111 of third fold-up baffle 26 engages bottom outer shell 14, and inner flanges 89, 113 of first and third fold-up baffles 22, 26 engage inlet tube 156, outlet tube 158, and intermediate tube 160 to define first subchamber 30 as shown, for example, in FIG. 5. Stiffening ribs 54, 74 define grooves 75 in which outer perimeter flanges 91, 111 of first and third fold-up baffles 22, 26, respectively, nest.

Second fold-up baffle 24 extends from base portion 17 of first inner plate 16 to top wall 42 of top outer shell 12 to lie substantially perpendicular to base portion 17 and top wall 42 as shown in FIG. 5. Outer perimeter flange 91 of second fold-up baffle 24 engages top outer shell 12 and inner flanges 89 of second fold-up baffle 24 engage inlet tube 156, outlet tube 158, and intermediate tube 160 to define second subchamber 32 between top outer shell 12, first inner plate 16, and first and second fold-up baffles 22, 24 as shown, for example, in FIG. 5. Outer perimeter flange 91 of second fold-up baffle 24 nests in a groove 75 formed by a stiffening rib 54.

Fourth fold-up baffle 28 is spaced apart from second fold-up baffle 24 and extends between top wall 42 of top outer shell 12 and base portion 19 of second inner plate 18 to lie substantially parallel to second fold-up baffle 24 as shown in FIG. 5. Outer perimeter flange 111 of fourth fold-up baffle 28 engages top outer shell 12 and inner flange 113 of fourth fold-up baffle 28 engages outlet tube 158 to define third subchamber 34 between top outer shell 12, second inner plate 18, and second and fourth fold-up baffles 24, 28 as shown, for example, in FIG. 5. Fourth fold-up baffle 28 also cooperates with top and bottom outer shells 12, 14, second inner plate 18, and third fold-up baffle 26 to define fourth subchamber 36 as shown, for example, in FIG. 5. Outer perimeter flange 111 of fourth fold-up baffle 28 nests in a groove 75 formed by a stiffening rib 54. In an alternative embodiment of the present invention, the flanges of the baffles are not nested in grooves but free-float between the top and bottom outer shells. Likewise, the flanges of the baffles may be welded or otherwise coupled to the top and bottom outer shells.

Inlet tube 156 is formed to communicate with an exhaust pipe (not shown) or another component of an exhaust system (not shown) and third subchamber 34. Inlet tube 156 includes a first end 164 that lies within inlet passageways 58, 78 formed in top and bottom outer shells 12, 14 and a second end 166 positioned adjacent to second and fourth fold-up baffles 24, 28 as shown, for example, in FIGS. 5 and 6. At second end 166 of inlet tube 156, inlet tube segment 82 of first inner plate 16 is formed to include an open end 168 and inlet tube segment 94 of second inner plate 18 is formed to include a closed end 170. Inner flange 89 of second fold-up baffle 24 engages inlet tube 156 adjacent to open end 168 and closed end 170 is positioned to lie adjacent to fourth fold-up baffle 28.

Outlet tube 158 is formed to communicate with the first subchamber 30 and an exhaust pipe (not shown) or another component of an exhaust system (not shown). Outlet tube 158 includes a first end 172 positioned adjacent to first and third fold-up baffles 22, 26 and a second end 174 that lies within outlet passageways 60, 80 formed in top and bottom outer shells 12, 14 as shown, for example, in FIGS. 5 and 6. At first end 172 of outlet tube 158, outlet tube segments 84, 96 of first and second inner plates 16, 18, respectively, are formed to include open ends 176, 178. Inner flange 89 of first fold-up baffle 22 engages outlet tube 158 adjacent to open end 176 and inner flange 113 of third fold-up baffle 26 engages outlet tube 158 adjacent to open end 178 as shown, for example, in FIG. 3.

Intermediate tube 160 is formed to communicate with the first and third subchambers 30, 34. Intermediate tube 160 includes a first end 180 positioned adjacent to first and third fold-up baffles 22, 26 and a second end 182 positioned adjacent to second and fourth fold-up baffles 24, 28 as shown, for example, in FIG. 6. At first end 180 of intermediate tube 160, intermediate tube segments 86, 98 of first and second inner plates 16, 18, respectively, are formed to include open ends 184, 186, respectively. Inner flange 89 of first fold-up baffle 22 engages intermediate tube 160 adjacent to open end 184 and inner flange 113 of third fold-up baffle 26 engages intermediate tube 160 adjacent to open end 186 as shown, for example, in FIG. 5. At second end 182 of intermediate tube 160, intermediate tube segment 86 of first inner plate 16 is formed to include an open end 188 and intermediate tube segment 98 of second inner plate 18 is formed to include a closed end 190. Inner flange 89 of second fold-up baffle 24 engages intermediate tube 160 adjacent to open end 188 and closed end 190 is positioned adjacent to fourth fold-up baffle 28.

By dividing first, second, third, and fourth fold-up baffles 22, 24, 26, 28 into split first and second baffle segments 88, 90, 110, 112, inlet and outlet tubes 156, 158 are permitted to include inlet and outlet tube portions 83, 183 that extend beyond first, second, third, and fourth fold-up baffles 22, 24, 26, 28 in their folded positions as shown, for example, in FIGS. 1, 3, 5, and 6. While defining first subchamber 30 between fold-up baffles 22, 26 and top and bottom outer shells outer shells 12, 14 and a portion of fourth subchamber 36 between fold-up baffle 28 and top and bottom outer shells 12, 14, as shown in FIG. 5, split baffle segments 88, 90, 110, 112 permit inlet and outlet tube portions 83, 183 to extend through respective subchambers 30, 36 between base portions 17, 19 of first and second inner plates 16, 18 to top and bottom outer shells 12, 14 as shown in FIG. 5. Thus, muffler 10 may include only four parts: 1) stamped top outer shell 12, 2) stamped bottom outer shell 14, 3) first stamped inner plate 16, and 4) second stamped inner plate 18.

In preferred embodiments of the present invention, muffler 10 includes a fifth part, tuning throat 192. Fourth fold-up baffle 28 is formed to include a tuning throat-receiving aperture 194 and tuning throat 192 is positioned to lie in tuning throat-receiving aperture 194 to extend into fourth subchamber 36 which is a Helmholtz tuning chamber as shown, for example, in FIGS. 5 and 6. Tuning throat 192 is secured to fourth fold-up baffle 28 by a press fit.

Figure 6:
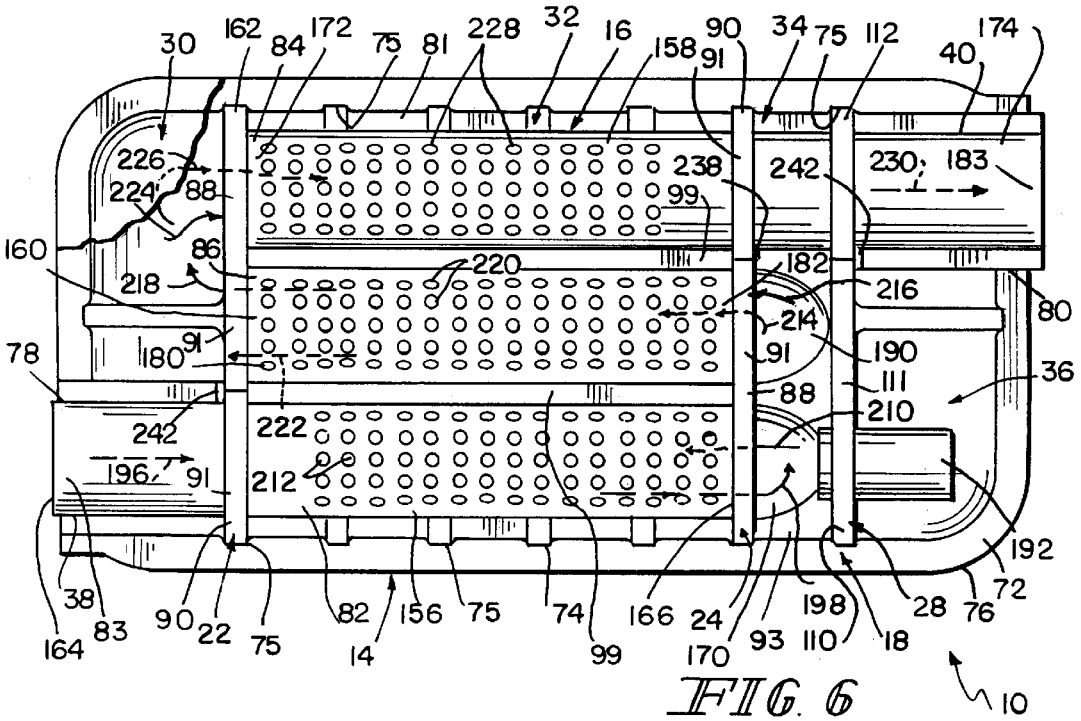
FIG. 6 is a top plan view of the first and second inner plates lying in the bottom outer shell showing the flow of exhaust gas along a serpentine path from a muffler inlet through the plurality of tubes to a muffler outlet.

Exhaust gas flows through a serpentine path through muffler 10. Exhaust gas enters muffler 10 through first end 164 of inlet tube 156 in direction 196 as shown in FIGS. 5 and 6. Exhaust gas flows through inlet tube 156 and exits inlet tube 156 in direction 198 into third subchamber 34. Open end 168 formed in inlet tube segment 82 and closed end 170 formed in inlet tube segment 94 define an exhaust gas passage 210 through which exhaust gas flows from inlet tube 156 into third subchamber 34. Inlet tube segment 82 of inlet tube 156 is formed to include perforations 212 through which exhaust gas in inlet tube 156 communicates with second subchamber 32.

Exhaust gas in third subchamber 34 communicates with fourth subchamber 36 through tuning throat 192. Exhaust gas continues flowing in direction 214 from third subchamber 34 into intermediate tube 160 as shown in FIG. 6. Open end 188 formed in intermediate tube segment 86 and closed end 190 formed in intermediate tube segment 98 define an exhaust gas passage 216. Exhaust gas flows through intermediate tube 160 and exits intermediate tube 160 in direction 218 into first subchamber 30 as shown in FIG. 6. Open ends 184, 186 formed in intermediate tube segments 86, 98 define an exhaust gas passage 222 through which exhaust gas flows from intermediate tube 160 into first subchamber 30 as shown in FIGS. 3, 4, and 6. Intermediate tube 160 is formed to include perforations 220 through which exhaust gas communicates with second subchamber 32.

Exhaust gas flows through first subchamber 30 from first end 180 of intermediate tube 160 to first end 172 of outlet tube 158 as shown in FIG. 6. Open ends 176, 178 formed in outlet tube segments 84, 96, respectively, define an exhaust gas passage 224. Exhaust gas flows in direction 226 from first subchamber 30 into outlet tube 158. Outlet tube 158 is formed to include perforations 228 through which exhaust gas in outlet tube 158 communicates with second subchamber 32. Exhaust gas exits muffler 10 in direction 230 through second end 174 of outlet tube 158 as shown in FIGS. 5 and 6. In alternative embodiments of the present invention, the inlet tube, outlet tube, and tube may be formed to include louvers (not shown) instead of perforations.

Muffler 10 includes four stamped parts 12, 14, 16, 18 (top and bottom stamped outer shells 12, 14 and first and second stamped inner plates 16, 18) that form three tubes 156, 158, 160 and four subchambers 30, 32, 34, 36 for exhaust gas to flow through. The reason that muffler 10 includes only four stamped parts is, in large part, because fold-up baffles 22, 24, 26, 28 include split baffle segments 88, 90, 110, 112. The split baffle segments 88, 90, 110, 112 permit inlet and outlet tubes 156, 158 to include inlet and outlet tube portions 83, 183 that extend past fold-up baffles 22, 24, 26, 28 in their folded position and into inlet and outlet passageways 58, 60, 78, 80 formed in top and bottom outer shells 12, 14.

Although the invention has been disclosed in detail with reference to certain preferred embodiments, variations and modifications exist within the scope and spirit of the invention.

What is claimed is:

1. A muffler comprising an outer shell defining a chamber therein, a first inner plate positioned in the chamber, the first inner plate including a base portion, and a second inner plate positioned in the chamber, the second inner plate including first, second, third, and fourth folds partitioning the second inner plate into a base portion including an outer periphery defining a base portion boundary, a first baffle segment integral with the base portion, a second baffle segment integral with the base portion, a third baffle segment integral with the base portion, a fourth baffle segment integral with the base portion, a first tube portion integral with the base portion and positioned outside the boundary of the base portion, and a second tube portion integral with the base portion and positioned outside the boundary of the base portion, the base portions of the inner plates cooperating to define a first baffle, the base portion of the second inner plate defining a plane partitioning the outer shell into first and second outer shell portions, the first and second baffle segments extending between the base portion of the second inner plate and the first outer shell portion to define a second baffle, and the third and fourth baffle segments extending between the base portion of the second inner plate and the second outer shell portion to define a third baffle.

2. The muffler of claim 1, wherein the first tube extends between the second baffle and the outer shell.

3. The muffler of claim 1, wherein the first baffle includes a first tube segment in communication with the first tube portion of the second inner plate to define a first tube and a second tube segment in communication with the second tube portion of the second inner plate to define a second tube.

4. The muffler of claim 3, wherein the first baffle includes a third tube segment defining a third tube positioned between the first and second tubes.

5. The muffler of claim 1, wherein the first inner plate includes first, second, third, and fourth folds partitioning the first inner plate into the base portion, a first baffle segment integral with the base portion of the first inner plate, a second baffle segment integral with the base portion of the first inner plate, a third baffle segment integral with the base portion of the first inner plate, a fourth baffle segment integral with the base portion of the first inner plate, the first and second baffle segments of the first inner plate cooperating to define a fourth baffle, the third and fourth baffle segments cooperating to define a fifth baffle.

6. The muffler of claim 5, wherein the base portion of the first inner plate includes an outer edge defining a base portion boundary, the first inner plate includes a first tube portion integral with the base portion of the first inner plate that is positioned outside the base portion boundary of the first inner plate and a second tube portion integral with the base portion of the first inner plate that is positioned outside the base portion boundary of the first inner plate and spaced apart from the first tube portion of the first inner plate.

7. The muffler of claim 5, wherein the fourth baffle extends between the base portion of the first inner plate and the first outer shell portion and the fifth baffle extends between the base portion of the first inner plate and the first outer shell portion.

8. A muffler comprising an outer shell defining a chamber therein, a first inner plate positioned in the chamber, and a second inner plate positioned in the chamber, the second inner plate including first and second folds partitioning the second inner plate into a base portion, a first baffle segment, and a second baffle segment, the first and second baffle segments cooperating to define a baffle extending between the outer shell and the base portion.

9. The muffler of claim 8, wherein the first baffle segment is mechanically coupled to the second baffle segment.

10. The muffler of claim 8, wherein the first baffle segment includes base portion and a flange coupled to the base portion of the first baffle segment that overlaps a portion of the second baffle segment.

11. The muffler of claim 8, wherein the first and second inner plates cooperate to define a tube and the baffle includes a tube-receiving aperture sized to receive the tube.

12. The muffler of claim 11, wherein the base portion includes an outer periphery defining a base portion boundary and a tube segment, the second inner plate includes a tube portion integral with the base portion, the tube portion is positioned outside of the boundary of the base portion, and the tube portion is in communication with the tube segment.

13. The muffler of claim 12, wherein the first inner plate includes a base portion having an outer periphery defining a base portion boundary and a tube segment, a tube portion integral with the base portion of the first inner plate, the tube portion of the first inner plate is positioned outside of the boundary of the base portion of the first inner plate, and the tube portion of the first inner plate is in communication with the tube segment of the first inner plate.

14. The muffler of claim 8, wherein the second inner plate includes third and fourth folds partitioning the second inner plate into a third baffle segment and a fourth baffle segment, the third and fourth baffle segments cooperate to define another baffle extending between the outer shell and the base portion.

15. The muffler of claim 8, wherein the first inner plate includes first and second folds partitioning the second inner plate into a base portion, a first baffle segment, and a second baffle segment, the first and second baffle segments of the first inner plate cooperate to define a baffle extending between the outer shell and the base portion of the first inner plate.

16. The muffler of claim 8, wherein the first baffle segment a base portion and a hinge portion between the base portion of the first baffle segment and the base portion of the second inner plate.

17. The muffler of claim 16, wherein the hinge portion includes a first segment and second segment that overlaps the first segment of the hinge portion.

18. The muffler of claim 8, wherein the first baffle segment is coupled to the base portion at a first location, the second baffle segment is coupled to the base portion at a second location, and the tube portion of the second inner plate is coupled to the base portion at a location between the first and second locations.

19. A muffler comprising an outer shell defining a chamber therein, a first inner plate positioned in the chamber, and a second inner plate positioned in the chamber, the second inner plate including a base portion including an outer periphery defining a base portion boundary, a baffle integral with the base portion and extending between the outer shell and the base portion, and a tube portion integral with the base portion, the tube portion being positioned outside of the base portion boundary.

20. The muffler of claim 19, wherein the second inner plate includes another tube portion integral with the base portion that is positioned outside the base portion boundary and spaced apart from the other tube portion.

21. The muffler of claim 19, wherein the tube portion extends between base portion and the outer shell portion.

22. The muffler of claim 19, wherein the first inner plate includes a base portion and a tube portion integral with the base portion, the base portion includes an outer periphery defining a base portion boundary, and the tube portion is positioned outside the base portion boundary.

23. The muffler of claim 22, wherein the first inner plate further includes a baffle integral with the base portion of the first inner plate and the baffle extends between the tube portion and the outer shell.

24. The muffler of claim 19, wherein the baffle includes a first baffle segment integrally coupled to the base portion at a first location and a second baffle segment integrally coupled to the base portion at a second location and the tube portion of the second inner plate is integrally coupled to the base portion at a location between the first and second locations.

25. The muffler of claim 19, wherein the baffle includes a first baffle segment integrally coupled to the base portion and a second baffle segment integrally coupled to the base portion and the first and second baffle segments are mechanically coupled to define the baffle.

26. The muffler of claim 19, wherein the second inner plate includes first and second folds partitioning the second inner plate into the base portion, a first baffle segment, and a second baffle segment, and the first and second baffle segments cooperate to define the baffle of the second inner plate.

27. A muffler comprising an outer shell defining a chamber therein, a first inner plate positioned in the chamber, the first inner plate including a base portion, and a second inner plate positioned in the chamber adjacent to the first inner plate, the second inner plate including a base portion, the base portion of the first inner plate and the base portion of the second inner plate cooperating to define a first baffle, the second inner plate further including a second baffle integrally coupled to the base portion and a third baffle integrally coupled to the base portion, the base portion of the second inner plate defining a plane partitioning the outer shell into first and second outer shell portions, the second baffle extending between the base portion of the second inner plate and the first outer shell portion, the third baffle extending between the base portion of the second inner plate and the second outer shell portion.

28. The muffler of claim 27, wherein the second inner plate includes first, second, third, and fourth folds partitioning the second inner plate into the base portion, the second baffle, and the third baffle.

29. The muffler of claim 27, wherein the second inner plate includes first and second baffle segments integrally coupled to the base portion and the first baffle segment is mechanically coupled to the second baffle segment to define the second baffle.

30. The muffler of claim 27, wherein the base portion of the second inner plate includes an outer periphery defining a base portion boundary, the second inner plate includes a tube portion integral with the base portion of the second inner plate, and the tube portion is positioned outside of the base portion boundary.

31. The muffler of claim 27, wherein the first inner plate includes a fourth baffle extending between the base portion of the first inner plate and the first outer shell portion and a fifth baffle extending between the base portion of the first inner plate and the first outer shell portion.

32. The muffler of claim 31, wherein the first and second outer shell portions and the first, second, and third baffles cooperate to define a subchamber.

33. The muffler of claim 31, wherein the first outer shell and the first, second, and fourth baffles cooperate to define a subchamber.

34. A muffler comprising an outer shell defining a chamber therein, a first inner plate positioned in the chamber, and a second inner plate positioned in the chamber, the second inner plate including a base portion, a baffle integral with the base portion and extending between the outer shell and the base portion, and a tube portion integral with the base portion, the baffle and the outer shell cooperating to define a subchamber, the tube portion extending into the subchamber between the base portion of the second inner plate and the outer shell.

35. The muffler of claim 34, wherein the baffle includes first and second baffle segments, the first baffle segment is coupled to the base portion of the second inner plate at a first location, the second baffle segment is coupled to the base portion of the second inner plate at a second location, and the tube portion is coupled to the base portion at a location between the first and second locations.

36. The muffler of claim 34, wherein the first and second inner plates cooperates with the tube portion to define a tube and the baffle includes a tube-receiving aperture sized to receive the tube.

37. A method of assembling a muffler, the method including the steps of providing an outer shell, a first inner plate, and a second inner plate, the second inner plate having a base portion, a first baffle segment, a second baffle segment, and a tube portion, folding the first baffle segment relative to the base portion, folding the second baffle segment relative to the base portion and the first baffle segment so that the second baffle segment is positioned over the tube portion to define a baffle with the first baffle segment, positioning the first inner plate adjacent the second inner plate, and positioning the first and second inner plates in the outer shell.

38. The method of claim 37, wherein the base portion of the second inner plate defines a plane defining a first region and a second region separated from the first region by the plane, the step of folding the first baffle segment includes folding the first baffle segment through a first angle so that the first baffle segment is positioned in the first region, the step of folding the second baffle segment includes the steps of folding the second baffle segment through a second angle so that the second baffle segment lies in the first region defined by the plane and folding the second baffle segment through a third angle so that second baffle segment lies on the second region defined by the plane.

39. The method of claim 38, wherein the first angle is 90 degrees, the second angle is 90 degrees, and the third angle is 180 degrees.

40. A method of assembling a muffler, the method including the steps of providing an outer shell, a first inner plate, and a second inner plate, the second inner plate having a base portion, a first baffle segment integral with the base portion, a second baffle segment integral with the base portion, and a tube portion integral with the base portion, positioning the first baffle segment in an upright position relative the base portion, positioning the second baffle segment relative the base portion so that the second baffle is positioned over the tube portion and the first and second baffle segments cooperate to define a baffle, positioning the first inner plate adjacent the second inner plate, and positioning the first and second inner plates in the outer shell.

41. The method of claim 40, wherein the step of positioning the first baffle segment includes folding the first baffle segment relative to the base portion and the second baffle segment.

42. The method of claim 40, wherein the step of positioning the second baffle segment includes folding the second baffle segment relative to the base portion and the first baffle segment.

* * * * *